US012595943B2

(12) United States Patent
Zamalis

(10) Patent No.: US 12,595,943 B2
(45) Date of Patent: Apr. 7, 2026

(54) ECONOMIZER PORT VALVE

(71) Applicant: Johnson Controls Tyco IP Holdings LLP, Milwaukee, WI (US)

(72) Inventor: Michael Hemi Zamalis, Mount Sidney, VA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 337 days.

(21) Appl. No.: 18/029,061

(22) PCT Filed: Sep. 29, 2021

(86) PCT No.: PCT/US2021/052702

§ 371 (c)(1),
(2) Date: Mar. 28, 2023

(87) PCT Pub. No.: WO2022/072533

PCT Pub. Date: Apr. 7, 2022

(65) Prior Publication Data

US 2023/0375237 A1 Nov. 23, 2023

Related U.S. Application Data

(60) Provisional application No. 63/084,987, filed on Sep. 29, 2020.

(51) Int. Cl.

| | |
|---|---|
| ***F25B 41/20*** | (2021.01) |
| ***F25B 1/10*** | (2006.01) |
| ***F25B 31/02*** | (2006.01) |

(52) U.S. Cl.

CPC ..... *F25B 41/20* (2021.01); *F25B 1/10* (2013.01); *F25B 31/026* (2013.01); *F25B 2400/13* (2013.01)

(58) Field of Classification Search

CPC . F25B 41/20; F16K 3/22; F16K 15/18; F16K 31/004

See application file for complete search history.

(56) References Cited

U.S. PATENT DOCUMENTS

| | | | |
|---|---|---|---|
| 5,556,271 | A | 9/1996 | Zuercher et al. |
| 2002/0021972 | A1 | 2/2002 | Vaisman |

(Continued)

FOREIGN PATENT DOCUMENTS

| | | | |
|---|---|---|---|
| CN | 102269489 | A | 12/2011 |
| CN | 107621100 | A | 1/2018 |

(Continued)

OTHER PUBLICATIONS

International Search Report and Written Opinion for PCT Application No. PCT/US2021/052702, mailed Jan. 3, 2022, 10 pages.

(Continued)

*Primary Examiner* — P. Macade Nichols
(74) *Attorney, Agent, or Firm* — Fletcher Yoder, P.C.

(57) ABSTRACT

A compressor of a heating, ventilation, and air conditioning (HVAC) system includes a casing having an inner volume and an inner surface defining the inner volume, where the inner volume is configured to accommodate a rotor therein. The compressor also includes an economizer port formed in the casing and configured to inject a flow of fluid into the inner volume and a valve disposed within the economizer port and configured to regulate the flow of fluid into the inner volume. The valve has an inward-facing surface, and the inward-facing surface is aligned with the inner surface of the casing in a closed position of the valve.

20 Claims, 5 Drawing Sheets

(56) References Cited

U.S. PATENT DOCUMENTS

| | | | | |
|---|---|---|---|---|
| 2005/0221147 | A1* | 10/2005 | Shioya | F16K 31/1266 429/513 |
| 2012/0027632 | A1 | 2/2012 | Nemit, Jr. et al. | |
| 2016/0273813 | A1* | 9/2016 | Ramos | F16K 11/044 |

FOREIGN PATENT DOCUMENTS

| | | | |
|---|---|---|---|
| CN | 109944955 | A | 6/2019 |
| EP | 3006740 | A1 | 4/2016 |
| GB | 2528214 | A | 1/2016 |
| JP | H07127586 | A | 5/1995 |
| JP | 2014092087 | A | 5/2014 |
| JP | 2017089498 | A | 5/2017 |
| KR | 20010079930 | A | 8/2001 |

OTHER PUBLICATIONS

European Extended Search Report for EP Application No. 21876417.3, dated Oct. 8, 2024, 10 pages.

Chinese Office Action for CN Application No. 202180066505.6, dated Nov. 9, 2024, 11 pages.

* cited by examiner

ECONOMIZER PORT VALVE

CROSS REFERENCE TO RELATED APPLICATION

This application is a U.S. National Stage Application of PCT International Application No. PCT/US2021/052702, entitled "ECONOMIZER PORT VALVE," filed Sep. 29, 2021, which claims priority to and the benefit of U.S. Provisional Patent Application No. 63/084,987, entitled "ECONOMIZER PORT VALVE," filed Sep. 29, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be noted that these statements are to be read in this light and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the chiller system. The chiller system may place a working fluid in a heat exchange relationship with a conditioning fluid (e.g., water) and may deliver the conditioning fluid to conditioning equipment and/or a conditioned environment serviced by the chiller system. In such applications, the conditioning fluid may be directed through downstream equipment, such as air handlers, to condition other fluids, such as air in a building.

In typical chillers, the conditioning fluid is cooled by an evaporator that places the working fluid in a heat exchange relationship with the conditioning fluid to absorb heat from the conditioning fluid and evaporate the working fluid. The working fluid is then compressed by a compressor and transferred to a condenser. In the condenser, the working fluid is cooled, typically by a water or air flow, and is condensed into a liquid. Air-cooled condensers typically include a condenser coil and a fan that forces air, such as ambient air, across the condenser coil. In some conventional designs, economizers (e.g., flash tanks) are utilized in the chiller system to improve performance (e.g., efficiency). In systems that employ economizers, the condensed working fluid may be directed from the condenser to the economizer where the liquid working fluid at least partially evaporates. The resulting vapor may be extracted from the economizer and be redirected to the compressor for compression, while the remaining liquid working fluid in the economizer is directed to the evaporator. Unfortunately, fluid connections (e.g., conduits and ports) between the economizer and the compressor in existing chiller systems may be susceptible to inefficiencies.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a compressor of a heating, ventilation, and air conditioning (HVAC) system includes a casing having an inner volume and an inner surface defining the inner volume, where the inner volume is configured to accommodate a rotor therein. The compressor also includes an economizer port formed in the casing and configured to inject a flow of fluid into the inner volume and a valve disposed within the economizer port and configured to regulate the flow of fluid into the inner volume. The valve has an inward-facing surface, and the inward-facing surface is aligned with the inner surface of the casing in a closed position of the valve.

In another embodiment, a compressor of an HVAC system includes a casing having an inner volume and an inner surface defining the inner volume, where the inner volume is configured to accommodate a rotor therein. The compressor also includes an economizer port formed in the casing and defining a bore configured to direct a flow of fluid into the inner volume and a valve disposed within the economizer port and configured to regulate the flow of fluid into the inner volume, where the valve is configured to enable fluid communication between the bore and the inner volume in an open position and block fluid communication between the bore and the inner volume in a closed position.

In a further embodiment, a compressor of an HVAC system includes a housing having an inner volume and an inner surface defining the inner volume, where the inner volume is configured to accommodate a rotor therein, an economizer port formed in the housing and configured to direct vapor refrigerant from an economizer of the HVAC system into the inner volume, and a valve disposed within the economizer port and configured to regulate a flow of vapor refrigerant into the inner volume, where the valve includes a main body having a radially inward surface, and the radially inward surface is substantially flush with the inner surface of the housing in a closed position of the valve.

DRAWINGS

Various aspects of this disclosure may be better understood upon reading the following detailed description and upon reference to the drawings in which.

Figure 2:
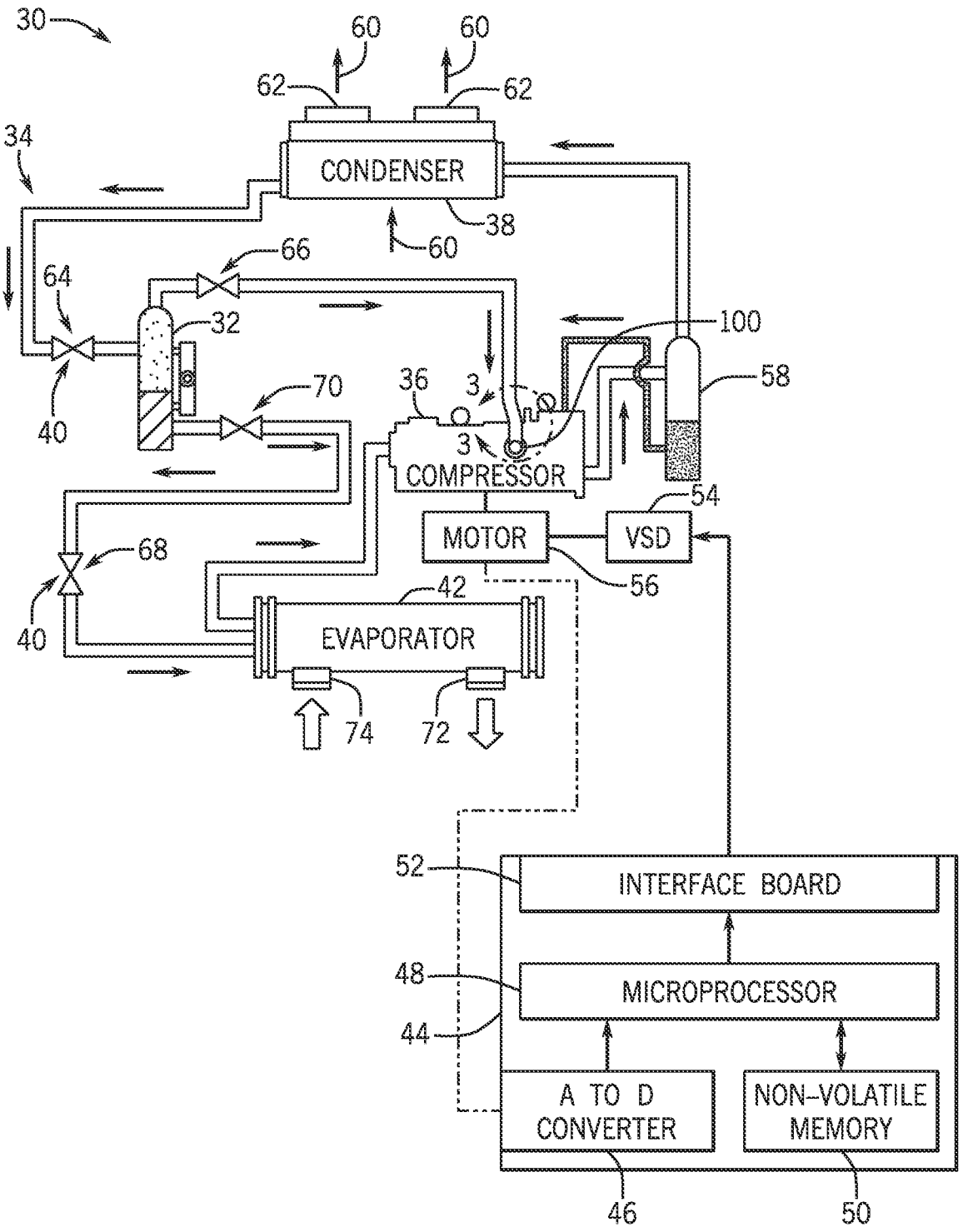
FIG. 2 is a schematic of an embodiment of a vapor compression system, in accordance with an aspect of the present disclosure.
Figure 4:
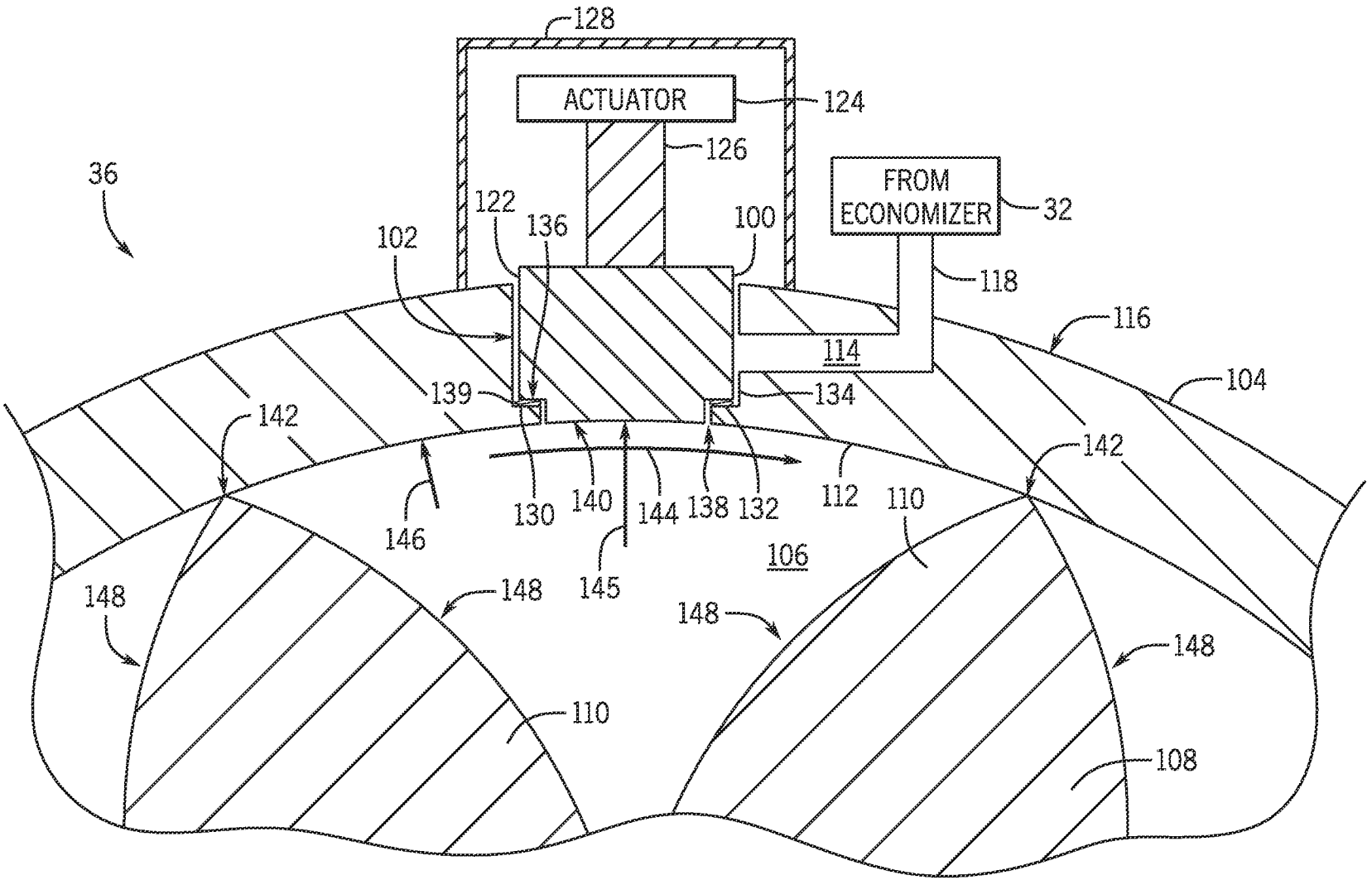
Figure 5:
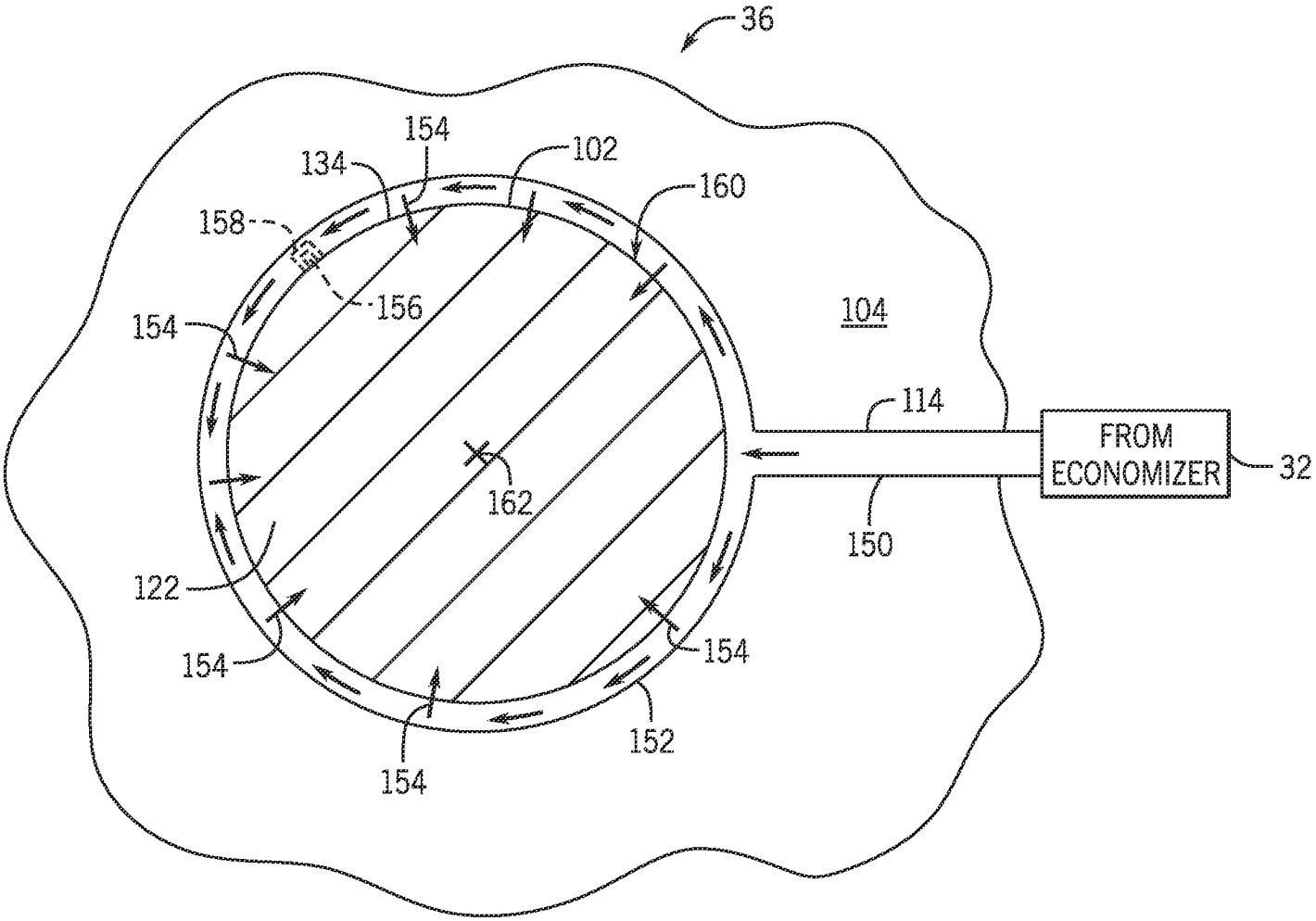

FIG. 4. is a partial cross-sectional axial view, taken within line 3-3 of FIG. 2, of an embodiment of a compressor, illustrating an economizer port and an economizer port valve of the compressor in a closed configuration, in accordance with an aspect of the present disclosure; and FIG. 5 is a schematic view of an embodiment of an economizer port and an economizer port valve of a compressor, in accordance with an aspect of the present disclosure.

DETAILED DESCRIPTION

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

Embodiments of the present disclosure relate to a heating, ventilation, and/or air conditioning (HVAC) system (e.g., a chiller system) configured to heat or cool a conditioning fluid (e.g., a liquid). The HVAC system includes a vapor compression system having a circuit, such as a vapor compression circuit, through which a working fluid (e.g., a refrigerant) is directed. The circuit of the vapor compression system may include, for example, a compressor, a condenser, an economizer (e.g., a flash tank), and an evaporator. The compressor is configured to pressurize the refrigerant and direct the pressurized refrigerant to the condenser, which is configured to cool and condense the refrigerant. The cooled, condensed refrigerant is directed to the economizer, where the refrigerant may at least partially vaporize. Vapor refrigerant is directed from the economizer to the compressor to be re-pressurized, while liquid refrigerant remaining in the economizer is directed to the evaporator to be placed in a heat exchange relationship with the conditioning fluid. At the evaporator, the refrigerant absorbs thermal energy or heat from the conditioning fluid, thereby cooling the conditioning fluid. The cooled conditioning fluid may be directed to air handling equipment for use in conditioning an air flow supplied to a building or other conditioned space.

As will be appreciated, the circuit may include various conduits fluidly coupling the compressor, condenser, economizer, and/or evaporator to enable flow of refrigerant therebetween. For example, conduits may couple to and extend between respective ports of the compressor, condenser, economizer, and/or evaporator. In certain embodiments, one or more of the conduits may include a valve disposed along the conduit to enable control of refrigerant flow through the respective conduit. As mentioned above, existing systems may include a conduit extending from the economizer to the compressor to direct vapor refrigerant from the economizer to the compressor. Unfortunately, such existing systems may be susceptible to inefficiencies. For example, a conduit extending from the economizer to the compressor may terminate at a housing of the compressor and may fluidly couple to an opening of the compressor housing that extends into a compression chamber (e.g., a rotor bore) of the compressor. In traditional configurations, a valve configured to regulate the flow of refrigerant from the economizer to the compressor may be disposed along the conduit upstream of the housing of the compressor (e.g., relative to a direction of refrigerant flow through the conduit). Thus, the compression chamber of the compressor may be fluidly coupled to the opening of the compressor housing and, in some embodiments, a portion of the conduit when the valve is open and also when the valve is closed.

The presence and continual exposure of the compressor housing opening to the compression chamber may cause inefficient operation of the compressor. For example, as a rotor of the compressor rotates within the compressor housing, lobes of the rotor may travel across the opening in the compressor housing. As will be appreciated, a pressure differential exists across each lobe of the rotor during operation of the compressor. When a lobe of the rotor travels across the exposed opening formed in the compressor housing, opposing sides of the lobe may be fluidly connected to one another via the opening. As a result, refrigerant on a high-pressure side of the lobe may travel to a low-pressure side of the lobe (e.g., across or around a tip of the lobe) via the opening, which results in a loss of efficiency.

Thus, it is presently recognized that there is a need to improve fluid connections between economizers and compressors to mitigate losses in efficiency. To this end, present embodiments are directed to a compressor having an economizer port with a valve disposed therein. More specifically, a casing (e.g., housing) of the compressor may include a fluid passage (e.g., a flow path) and an economizer port formed therein, and a valve may be disposed within the economizer port and/or at least partially within the casing. In an open configuration, the valve is configured to enable fluid coupling of the fluid passage and the economizer port to thereby enable flow of vapor refrigerant from an economizer into the compressor. In a closed configuration, the valve is configured to fill, seal, or plug the economizer port, thereby interrupting fluid connection of the fluid passage and the economizer port. Additionally, in the closed configuration, the valve (e.g., a surface of the valve) is configured to align with an inner surface of a rotor bore of the compressor in a systematized arrangement. That is, a surface of the valve may be generally flush or even with the inner surface of the rotor bore to form a substantially continuous surface along which lobes of a rotor of the compressor may travel during operation of the compressor. Thus, when the valve is in the closed configuration, the economizer port is obstructed, thereby blocking opposing sides of a lobe traveling across and/or along the economizer port from fluid connection with one another. In this way, undesirable flow of refrigerant across tips of the lobes or rotor (e.g., via the economizer port) is mitigated, which may improve efficient operation of the compressor and the vapor compression system generally.

Figure 1:
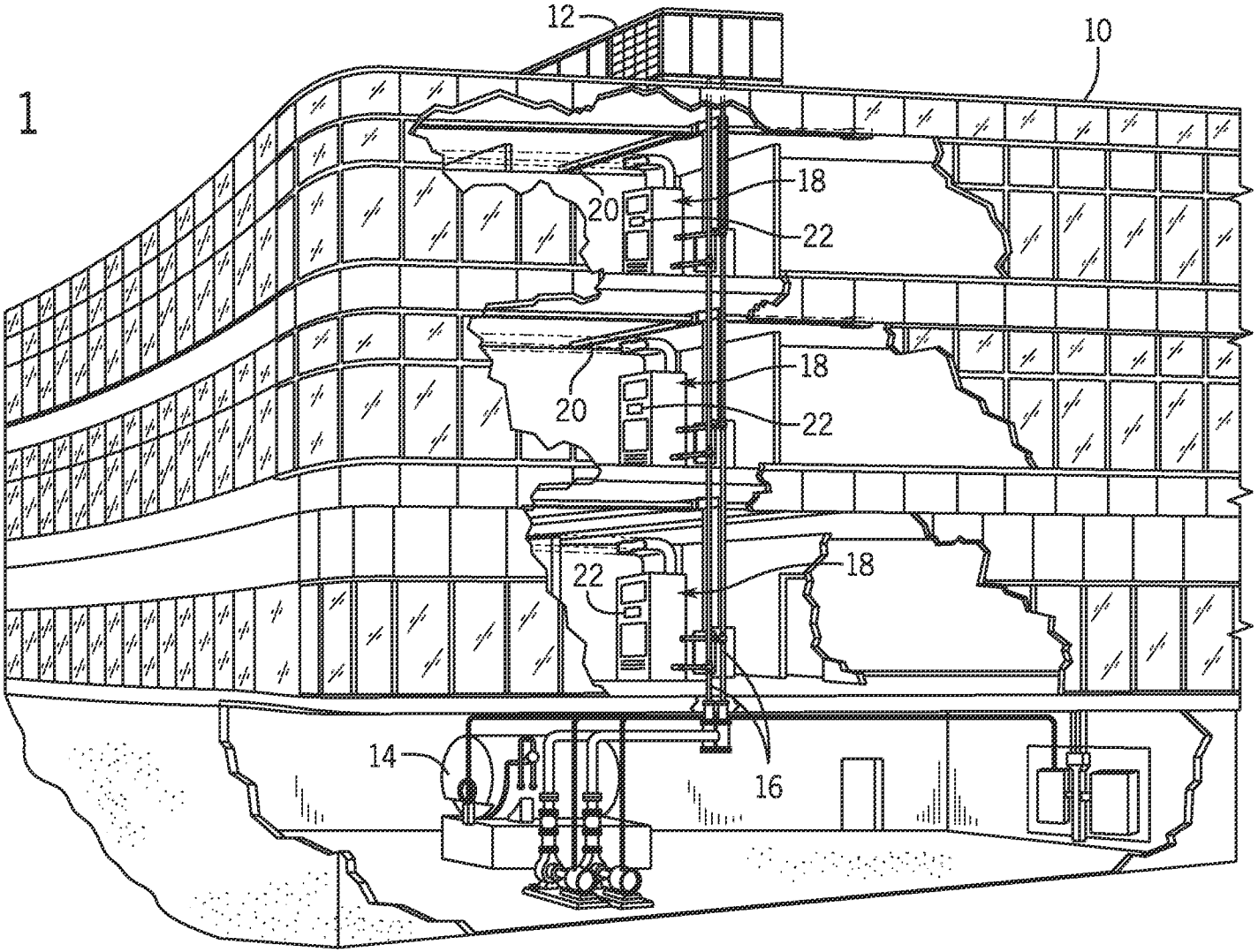
FIG. 1 is a perspective view of a building that may utilize an embodiment of a heating, ventilation, and/or air conditioning (HVAC) system in a commercial setting, in accordance with an aspect of the present disclosure.

Turning now to the drawings, FIG. 1 is a perspective view of an embodiment of an application for a heating, ventilation, and air conditioning (HVAC) system. Such systems, in general, may be applied in a range of settings, both within the HVAC field and outside of that field. The HVAC systems may provide cooling to data centers, electrical devices, freezers, coolers, or other environments through vapor-compression refrigeration, absorption refrigeration, or thermoelectric cooling. In presently contemplated applications, however, HVAC systems may be used in residential, commercial, light industrial, industrial, and/or in any other application for heating or cooling a volume or enclosure, such as a residence, building, structure, and so forth. Moreover, the HVAC systems may be used in industrial applications, where appropriate, for basic cooling and heating of various fluids.

The illustrated embodiment shows an HVAC system for building environmental management that may utilize heat exchangers. A building 10 is cooled by a system that includes a chiller 12 and a boiler 14. As shown, the chiller 12 is disposed on the roof of building 10, and the boiler 14 is located in the basement; however, the chiller 12 and boiler 14 may be located in other equipment rooms or areas next to the building 10. The chiller 12 may be an air-cooled or water-cooled device that implements a refrigeration cycle to cool water or other conditioning fluid. The chiller 12 is housed within a structure that includes a refrigeration circuit, a free cooling system, and associated equipment such as pumps, valves, and piping. For example, the chiller 12 may be single packaged rooftop unit that incorporates a free cooling system. The boiler 14 is a closed vessel in which water is heated. The water from the chiller 12 and the boiler 14 is circulated through the building 10 by water conduits 16. The water conduits 16 are routed to air handlers 18 located on individual floors and within sections of the building 10.

The air handlers 18 are coupled to ductwork 20 that is adapted to distribute air between the air handlers 18 and may receive air from an outside intake (not shown). The air handlers 18 include heat exchangers that circulate cold water from the chiller 12 and hot water from the boiler 14 to provide heated or cooled air to conditioned spaces within the building 10. Fans within the air handlers 18 draw or force air across the heat exchangers to condition the air and direct the conditioned air to environments within building 10, such as rooms, apartments, or offices, to maintain the environments at a designated temperature. A control device, shown in the illustrated embodiment as including a thermostat 22, may be used to designate the temperature of the conditioned air. The control device 22 may also be used to control the flow of air through and from the air handlers 18. Other devices may be included in the system, such as control valves that regulate the flow of water and pressure and/or temperature transducers or switches that sense the temperatures and pressures of the water, the air, and so forth. Moreover, the control devices 22 may include computer systems that are integrated with or separate from other building control or monitoring systems, and even systems that are remote from the building 10.

FIG. 2 is a schematic of an embodiment of a vapor compression system 30 (e.g., an HVAC system) configured to utilize a working fluid, such as a refrigerant, to transfer thermal energy between various fluid flows, such as water and/or air. For example, the vapor compression system 30 may be a part of an air-cooled chiller (e.g., chiller 12). However, it should be appreciated that the disclosed techniques may be incorporated with a variety of other types of chillers, vapor compression systems, or other HVAC systems. The vapor compression system 30 includes a refrigerant circuit 34 configured to circulate a working fluid, such as refrigerant, therethrough with a compressor 36 (e.g., a screw compressor) disposed along the refrigerant circuit 34. The refrigerant circuit 34 also includes an economizer (e.g., a flash tank) 32, a condenser 38, expansion valves or devices 40, and a liquid chiller or evaporator 42. The components of the refrigerant circuit 34 enable heat transfer between the working fluid and other fluids (e.g., a conditioning fluid, a cooling fluid, air, water, etc.) in order to condition at least one of the fluids and provide conditioning to an environment, such as an interior of the building 10.

Some examples of working fluids that may be used as refrigerants in the vapor compression system 30 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon-based refrigerants, water vapor, refrigerants with low global warming potential (GWP), or any other suitable refrigerant. In some embodiments, the vapor compression system 30 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

The vapor compression system 30 may further include a control panel 44 (e.g., controller) that includes an analog to digital (A/D) converter 46, a microprocessor 48, a non-volatile memory 50, and/or an interface board 52. In some embodiments, the vapor compression system 30 may include one or more of a variable speed drive (VSD) 54 and a motor 56. The motor 56 may drive the compressor 36 and may be powered by the VSD 54. The VSD 54 is configured to receive alternating current (AC) power having a particular fixed line voltage and fixed line frequency from an AC power source and to provide power having a variable voltage and frequency to the motor 56 in order to drive operation of the compressor 36. In other embodiments, the motor 56 may be powered directly from an AC or direct current (DC) power source. The motor 56 may include any type of electric motor that can be powered by the VSD 54 or directly from an AC or DC power source, such as a switched reluctance motor, an induction motor, an electronically commutated permanent magnet motor, or another suitable motor.

The compressor 36 is configured to compress a refrigerant vapor within the refrigerant circuit 34 and deliver the compressed refrigerant vapor to an oil separator 58 configured to separate oil from the refrigerant vapor. The refrigerant vapor is then directed along the refrigerant circuit 34 toward the condenser 38, and the oil is returned to the compressor 36. The refrigerant vapor delivered to the condenser 38 may transfer heat to a cooling fluid at the condenser 38. For example, the cooling fluid may be ambient air 60 forced across heat exchanger coils of the condenser 38 by condenser fans 62. The refrigerant vapor within the heat exchanger coils may condense to a refrigerant liquid in the condenser 38 via thermal heat transfer with the cooling fluid (e.g., the ambient air 60).

The liquid refrigerant exits the condenser 38 and then continues flow along the refrigerant circuit 34 to a first expansion device 64 (e.g., expansion device 40, electronic expansion valve, etc.). The first expansion device 64 may be an economizer feed valve configured to control flow of the liquid refrigerant to the economizer 32. The first expansion device 64 is also configured to lower the pressure of (e.g., expand) the liquid refrigerant received from the condenser 38. During the expansion process, a portion of the liquid refrigerant may vaporize, and thus, the economizer 32 may be used to separate the vapor refrigerant from the liquid refrigerant received from the first expansion device 64. Additionally, the economizer 32 may provide for further expansion of the liquid refrigerant due to a pressure drop experienced by the liquid refrigerant when entering the economizer 32 (e.g., due to a rapid increase in volume experienced by the liquid refrigerant when entering the economizer 32).

The vapor refrigerant in the economizer 32 may exit and flow along the refrigerant circuit 34 to the compressor 36. For example, the vapor refrigerant may be drawn to an intermediate stage or discharge stage of the compressor 36 (e.g., not the suction stage). A valve 66 (e.g., economizer valve, solenoid valve, etc.) may be included in the refrigerant circuit 34 to control flow of the vapor refrigerant from the economizer 32 to the compressor 36. In some embodiments, when the valve 66 is open (e.g., fully open), additional liquid refrigerant within the economizer 32 may vaporize and provide additional subcooling of the liquid refrigerant within the economizer 32. In accordance with present techniques, the refrigerant circuit 34 also includes a valve 100 (e.g., economizer port valve) disposed at an economizer port of the compressor 36 to regulate flow of the vapor refrigerant from the economizer 32 to the compressor 36. The refrigerant circuit 34 may include the valve 100 instead of or in addition to the valve 66. Details of the valve 100 and the compressor 36 are discussed in further detail below.

The liquid refrigerant that collects in the economizer 32 may be at a lower enthalpy than the liquid refrigerant exiting the condenser 38 due to the expansion of the liquid refrigerant at the first expansion device 64 and/or the economizer 32. The liquid refrigerant may flow from the economizer 32, through a second expansion device 68 (e.g., expansion device 40, an orifice, etc.), and to the evaporator 42. In some embodiments, the refrigerant circuit 34 may also include a valve 70 (e.g., drain valve) configured to regulate flow of liquid refrigerant from the economizer 32 to the evaporator 42. For example, the valve 70 may be controlled (e.g., via the control panel 44) based on an amount of suction superheat of the liquid refrigerant.

The liquid refrigerant delivered to the evaporator 42 may absorb heat from a conditioning fluid, which may or may not be the same cooling fluid used in the condenser 38. The liquid refrigerant in the evaporator 42 may undergo a phase change to become vapor refrigerant. For example, the evaporator 42 may include a tube bundle fluidly coupled to a supply line 72 and a return line 74 that are connected to a cooling load (e.g., air handlers 18). The conditioning fluid (e.g., water, oil, calcium chloride brine, sodium chloride brine, or any other suitable fluid) enters the evaporator 42 via the return line 74 and exits the evaporator 42 the via supply line 72. The evaporator 42 may reduce the temperature of the conditioning fluid in the tube bundle via thermal heat transfer with the refrigerant so that the conditioning fluid may be utilized to provide cooling for a conditioned environment. The tube bundle in the evaporator 42 can include a plurality of tubes and/or a plurality of tube bundles. In any case, the refrigerant vapor exits the evaporator 42 and returns to the compressor 36 by a suction line to complete the refrigerant cycle.

Figure 3:
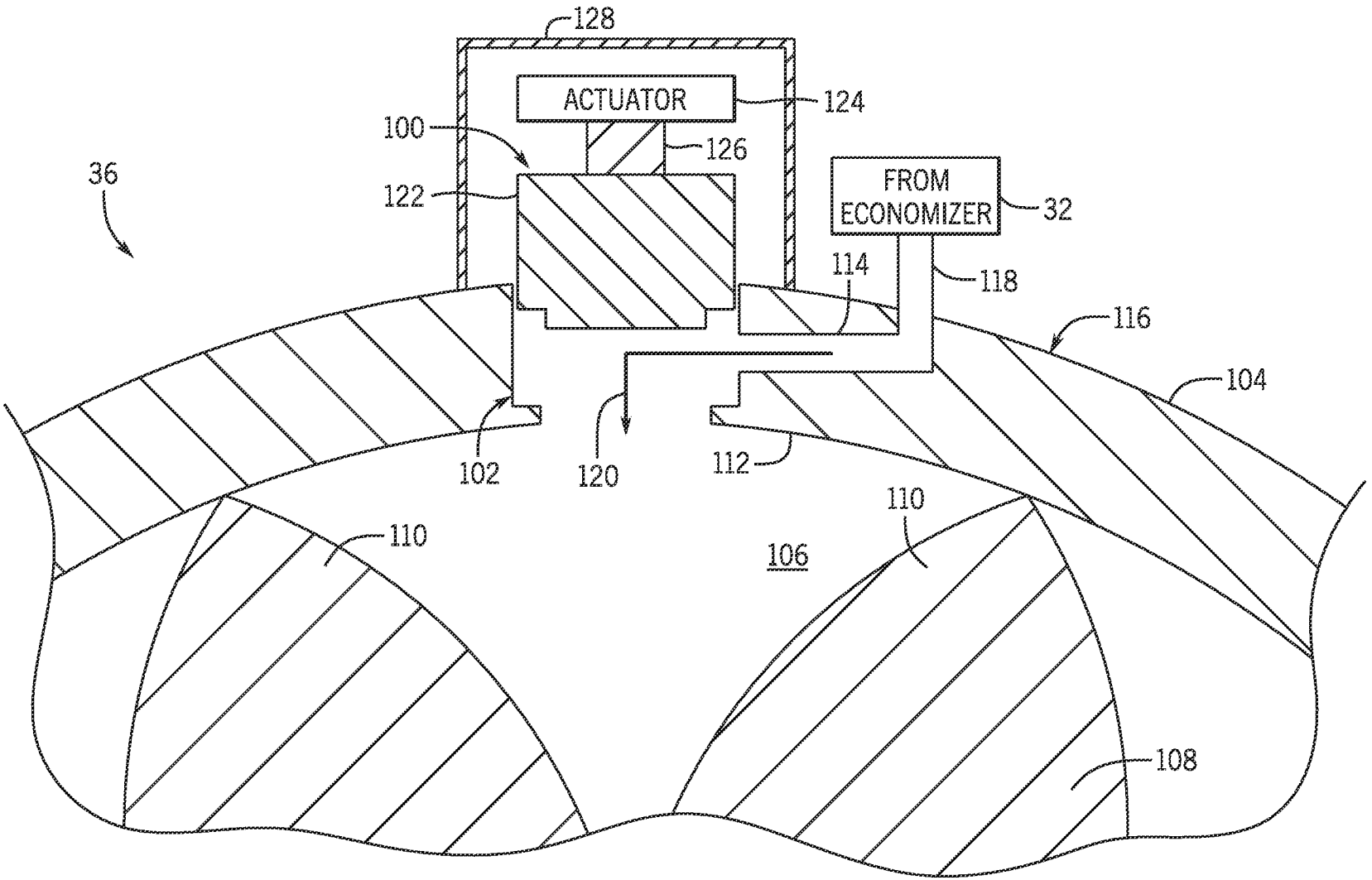
FIG. 3 is a partial cross-sectional axial view, taken within line 3-3 of FIG. 2, of an embodiment of a compressor, illustrating an economizer port and an economizer port valve of the compressor in an open configuration, in accordance with an aspect of the present disclosure.

With this in mind, FIG. 3 is a partial cross-sectional axial view, taken within line 3-3 of FIG. 2, of an embodiment of the compressor 36, illustrating an economizer port 102 formed in a casing (e.g., housing) 104 of the compressor 36 and illustrating the valve 100 disposed within the economizer port 102. In the illustrated embodiment, the valve 100 is shown in an open configuration whereby the valve 100 enables refrigerant flow from the economizer 32 into an inner volume 106 of the compressor 36 via the economizer port 102.

The casing 104 generally defines the inner volume 106 of the compressor 36 in which vapor refrigerant is pressurized. As shown, a rotor (e.g., a screw) 108 is disposed within the inner volume 106. While one rotor 108 is shown in the illustrated embodiment for clarity, it should be appreciated that the compressor 36 may include two rotors 108 that mesh with one another within the inner volume 106. Specifically, lobes 110 of the rotors 108 may mesh or mate with one another to form a series of chambers between the rotors 108. The lobes 110 of each rotor 108 may also form chambers between the rotor 108 and the casing 104. As the rotors 108 rotate within the casing 104, vapor refrigerant is forced through the chambers (e.g., from a suction side to a pressure side of the compressor 36) and is pressurized. In order to form the chambers through which the refrigerant is directed, the lobes 110 of the rotor 108 are sized and/or dimensioned to form a tight tolerance, seal, and/or interface with an inner surface 112 (e.g., inner diameter) of the casing 104 (e.g., a rotor bore of the casing 104) that generally defines the inner volume 106. Thus, as the rotor 108 rotates, the lobes 110 may travel along and/or adjacent the inner surface 112 (e.g., rotor bore) of the casing 104 and cause pressurization of the refrigerant within the inner volume 106.

As mentioned above, the casing 104 of the compressor 36 includes the economizer port 102 formed therein, which is configured to direct vapor refrigerant from the economizer 32 into the inner volume 106 of the compressor 36. The economizer port 102 may be formed in any suitable portion of the casing 104. For example, the economizer port 102 may be aligned (e.g., axially aligned) with an intermediate stage (e.g., between first and second stages) of the compressor 36. Further, while one economizer port 102 and corresponding valve 100 are shown in the illustrated embodiment, other embodiments may include multiple economizer ports 102 and corresponding valves 100.

When the valve 100 is in the illustrated open configuration, the economizer port 102 is fluidly coupled with a fluid passage 114 that is also formed in the casing 104. In the illustrated embodiment, the fluid passage 114 is integrally formed in the casing 104 and extends from an outer or external surface 116 of the casing 104 to the economizer port 102. As will be appreciated, the refrigerant circuit 34 may include a conduit 118 extending from the fluid passage 114 (e.g., from the outer surface 116) to the economizer 32 or to another component (e.g., the valve 66) configured to receive vapor refrigerant from the economizer 32. However, in other embodiments, the fluid passage 114 may have other configurations and/or structure configured to deliver vapor refrigerant from the economizer 32 to the economizer port 102 of the compressor 36. In any case, when the valve 100 is in the open configuration, vapor refrigerant from the economizer 32 may be directed into the inner volume 106 via the fluid passage 114 and the economizer port 102, as indicated by arrow 120.

The valve 100 may have any of a variety of configurations. For example, the valve 100 may be a poppet valve, a piston valve, a solenoid valve, a modulating valve, or any other suitable type of valve. The valve 100 includes a main body 122 (e.g., a poppet, a piston, etc.) that is actuated by an actuator 124. The main body 122 may be formed from any suitable material, such as cast iron or steel, and is disposed within the economizer port 102. The main body 122 translates within the economizer port 102 between open and closed configurations via operation of the actuator 124. In certain embodiments, the actuator 124 may be an electrical coil, a solenoid, a pneumatic actuator, a hydraulic actuator, or any other suitable type of actuator. In an embodiment of the valve 100 having a pneumatic actuator or hydraulic actuator, refrigerant or oil, respectively, of the refrigerant circuit 34 may be utilized as a motive fluid to drive operation of the actuator 124. To enable positioning of the main body 122 within the economizer port 102, the actuator 124 may be coupled to the main body 122 via a shaft 126, a lever, or other type of linkage. The actuator 124, shaft 126, and/or other components of the valve 100 may be enclosed in a housing 128 coupled (e.g., sealed) to the casing 104 and configured to contain any inadvertent flow of vapor refrigerant or motive fluid external to the casing 104.

The position of the valve 100 within the economizer port 102 may be regulated in accordance with a control scheme. For example, the control panel 44 (FIG. 2) or other control circuitry of the vapor compression system 30 may be communicatively coupled to the actuator 124 and may be configured to regulate operation of the actuator 124 to adjust the position of the valve 100. In some embodiments, the control panel 44 may be configured to adjust the position of the valve 100 based on feedback (e.g., sensor feedback) received by the control panel 44, based on a target operating parameter of the vapor compression system 30 (e.g., a target amount of subcooling), based on an operating mode of the vapor compression system 30, based on any other suitable criteria, and/or any combination thereof. The position of the valve 100 may be adjusted between the open configuration shown in FIG. 3 (e.g., a fully opened position) to fluidly couple the inner volume 106 and the fluid passage 114 to enable unrestricted flow of vapor refrigerant through the economizer port 102 and into the inner volume 106 of the compressor 36, the closed configuration shown in FIG. 4 (e.g., a fully closed position) to fully block vapor refrigerant flow into the compressor 36 via the economizer port 102 (e.g., to fluidly separate the inner volume 106 and the fluid passage 114), or any intermediate position therebetween to enable partial vapor refrigerant flow into the compressor 36 via the economizer port 102.

As mentioned above, FIG. 4 is a partial cross-sectional axial view, taken within line 3-3 of FIG. 2, of an embodiment of the compressor 36, illustrating the valve 100 in a closed configuration, whereby the valve 100 blocks vapor refrigerant flow from the economizer 32 into the inner volume 106 of the compressor 36 via the economizer port 102. In other words, the main body 122 of the valve 100 is disposed within the economizer port 102, such that the main body 122 interrupts the fluid connection between the fluid passage 114 of the casing 104 and the economizer port 102.

In the closed configuration of the valve 100, the main body 122 of the valve 100 abuts a valve seat 130 of the economizer port 102 formed in the casing 104. For example, the valve seat 130 may be defined by a protrusion 132 (e.g., annular protrusion) extending radially inward (e.g., relative to a central axis of the economizer port 102) from a bore 134 formed in the casing 104 and defining the economizer port 102. The main body 122 includes an indentation or recess 136 configured to mate and/or engage with the valve seat 130 to create a sealing interface 138 between the main body 122 and the valve seat 130. In the closed configuration of the valve 100, the valve seat 130 (e.g., the protrusion 132) may be disposed within the recess 136 and be engaged with the main body 122 of the valve 100. In this way, the valve seat 130 provides a physical stop and a seal between the valve 100 and the economizer port 102 in the closed configuration. In some embodiments, the valve seat 130 and/or the main body 122 may include a sealing element 139, such as a gasket (e.g., polymer, elastomer, etc.), surface treatment, or other feature, to enhance the sealing interface 138 between the economizer port 102 and the main body 122 of the valve 100 when the valve 100 is in the closed position. In some embodiments, the sealing element 139 may be secured to the main body 122 and disposed within the recess 136. In other embodiments, the sealing element 139 may be secured to the valve seat 130 (e.g., the protrusion 132). In any case, when the valve 100 is in the closed configuration, the sealing element 139 may be captured between the valve seat 130 and the main body 122 (e.g., the recess 136), such as relative to a central axis of the valve 100, to provide the sealing interface 138. Similarly, the economizer port 102 and the main body 122 may be manufactured to have a desirable (e.g., limited) tolerance that enables translation of the main body 122 relative to the economizer port 102 while also enabling sealing (e.g., fluid isolation) of the fluid passage 114 and the economizer port 102 in the closed position of the valve 100.

As mentioned above, in the closed configuration, the valve 100 is configured to align with the inner surface 112 of the casing 104 (e.g., a rotor bore of the compressor 36). In particular, an inner surface (e.g., inward-facing surface, radially inner surface, etc.) 140 of the main body 122 is generally flush, aligned, or even with the inner surface 112 of the casing 104 to form a substantially continuous surface along which the lobes 110 of the rotor 108 may travel during operation of the compressor 36. When the valve 100 is in the closed configuration, the bore 134 (e.g., a volume defined by the bore 134) is not exposed to the inner volume 106 of the casing 104 because the main body 122 of the valve 100 completely or substantially completely occupies the space or volume defined by the bore 134.

With the inner surface 140 of the main body 122 aligned (e.g., flush) with the inner surface 112 of the casing, tips 142 of the lobes 110 may smoothly travel, as indicated by arrow 144, along the inner surface 112 of the casing 104, along the inner surface 140 of the main body 122, and again to the inner surface 112 of the casing 104 as the rotor 108 rotates within the casing 104. To this end, in some embodiments, the inner surface 140 of the main body 122 may have the same, similar, or substantially similar (e.g., within 1, 2, 3, 4, or 5 percent) radius of curvature as that of the inner surface 112 of the casing 104. That is, the inner surface 140 may have a first radius of curvature 145, the inner surface 112 may have a second radius of curvature 146, and the first radius of curvature 145 and the second radius of curvature 146 may be substantially similar to one another. Thus, when the valve 100 is in the closed configuration, the economizer port 102 is completely or substantially completely obstructed or sealed, thereby blocking opposing sides 148 of the lobe 110 (e.g., a high-pressure side and a low-pressure side) from fluid connection with one another via an opening or cavity (e.g., space defined by the bore 134) of the economizer port 102. Tn this way, undesirable flow of refrigerant across the tips 142 of the lobes 110 (e.g., via the economizer port 102) is mitigated, which may improve efficient operation of the compressor 36 and the vapor compression system 30 generally.

FIG. 5 is a schematic radial view of an embodiment of the economizer port 102 formed in the casing 104 of the compressor 36 and the valve 100 disposed within the economizer port 102. In the illustrated embodiment, the fluid passage 114 formed in the casing 104 includes a first portion 150 and a second portion 152. The first portion 150 may extend from the outer surface 116 of the casing 104, through a body of the casing 104, to the second portion 152. The second portion 152 of the fluid passage 114 extends about the economizer port 102 (e.g., about a circumference 160 of the bore 134 of the economizer port 102) and thus encircles the economizer port 102 and the main body 122 of the valve 100. In other words, the second portion 152 of the fluid passage 114 has a generally annular configuration. Vapor refrigerant directed through the fluid passage 114 from the economizer 32 may flow through the first portion 150 to the second portion 152. When the valve 100 is in the open configuration, vapor refrigerant may flow from the second portion 152 into the economizer port 102, as indicated by arrows 154, around the perimeter or circumference 160 of the economizer port 102 (e.g., the bore 134). In this way, more even injection of the vapor refrigerant into the economizer port 102 and the inner volume 106 of the compressor 36 is enabled.

The illustrated embodiment of the valve 100 also include anti-rotation features configured to block rotation of the valve 100 (e.g., the main body 122) within the economizer port 102 (e.g., the bore 134). The main body 122 includes a protrusion 156 (e.g., a pin) extending radially outward from the main body 122 (e.g., relative to a central axis 162 of the main body 122). The protrusion 156 extends into a recess 158 formed in the bore 134 defining the economizer port 102. The recess 158 may extend axially along the bore 134 (e.g., relative to the central axis 162 of the bore 134 and/or economizer port 102). Thus, the protrusion 156 may travel within the recess 158 in the direction of the central axis 162 as the valve 100 is actuated between open and closed configurations. However, the protrusion 156 within the recess 158 may block rotational motion (e.g., about the central axis 162) of the valve 100 relative to the economizer port 102. It should be appreciated that the protrusion 156 and the recess 158 may have any suitable geometries (e.g., corresponding geometries), shapes, configurations, and/or arrangements to enable axial translation of the main body 122 of the valve 100 within the economizer port 102 while also blocking rotation of the main body 122 within the bore 134 of the economizer port 102.

As set forth above, the present disclosure may provide one or more technical effects useful in the operation of an HVAC system. As discussed above, present embodiments include the valve 100 positioned at and/or within the economizer port 102 formed in the casing 104 of the compressor 36. The valve 100 may be actuated between open and closed configurations or positions to regulate flow of vapor refrigerant from the economizer 32 into the compressor 36. In the closed configuration, the valve 100 seals or plugs the economizer port 102 to block refrigerant flow into the compressor 36 via the economizer port 102. Additionally, in the closed configuration, the inner surface 140 of the main body 122 of the valve 144 is aligned or flush with the inner surface 112 of the casing 104 that generally defines the inner volume 106 of the compressor 36 in which refrigerant is pressurized. In this way, the valve 100 and the casing 104 form a generally continuous surface along with the lobes 110 of the rotor 108 may smoothly translate during operation of the compressor 36. Further, the generally continuous surface formed by the valve 100 and the casing 104 when the valve 100 is closed substantially eliminates bypass of refrigerant flow from one side of the lobe 110 to another via the economizer port 102 formed in the casing 104. In this way, efficient operation of the compressor 36 is improved.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures), mounting arrangements, use of materials, colors, orientations) without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A compressor of a heating, ventilation, and air conditioning (HVAC) system, comprising:

a casing comprising an inner volume and an inner surface defining the inner volume, wherein the inner volume is configured to accommodate a rotor therein;

an economizer port formed in the casing and configured to direct a flow of fluid into the inner volume; and a valve disposed within the economizer port and configured to regulate the flow of fluid into the inner volume, wherein the valve comprises an inward-facing surface, and wherein the inward-facing surface is aligned with the inner surface of the casing in a closed position of the valve.

2. The compressor of claim 1, wherein the inner surface of the casing comprises a first radius of curvature, the inward-facing surface of the valve comprises a second radius of curvature, and the first and second radii of curvature are substantially the same.

3. The compressor of claim 1, wherein the casing comprises a fluid passage formed in the casing, wherein the fluid passage extends from an outer surface of the casing to the economizer port.

4. The compressor of claim 3, comprising an actuator coupled to the valve, wherein the actuator is configured to transition the valve between the closed position and an open position, the valve enables fluid coupling of the economizer port and the fluid passage in the open position, and the valve interrupts fluid coupling of the economizer port and the fluid passage in the closed position.

5. The compressor of claim 3, wherein the fluid passage of the casing is fluidly coupled to an economizer of the HVAC system via a conduit, and the flow of fluid is a vapor refrigerant flow discharged by the economizer.

6. The compressor of claim 1, wherein the valve is a poppet valve.

7. The compressor of claim 1, wherein the casing comprises a bore formed therein and configured to be fluidly coupled to the inner volume, the bore defines the economizer port, the bore comprises a valve seat, and the valve is configured to abut the valve seat in the closed position.

8. The compressor of claim 7, wherein the valve comprises a recess, and the valve seat is configured to be disposed within the recess and engage with the valve to create a sealing interface in the closed position.

9. The compressor of claim 8, comprising a sealing element disposed between the valve seat and the recess relative to a central axis of the valve.

10. The compressor of claim 1, wherein the economizer port is formed in the casing at an intermediate stage of the compressor.

11. A compressor of a heating, ventilation, and air conditioning (HVAC) system, comprising:

a casing comprising an inner volume and an inner surface defining the inner volume, wherein the inner volume is configured to accommodate a rotor therein;

an economizer port formed in the casing and defining a bore configured to direct a flow of fluid into the inner volume; and a valve disposed within the economizer port and configured to regulate the flow of fluid into the inner volume, wherein the valve is configured to enable fluid communication between the bore and the inner volume in an open position and block fluid communication between the bore and the inner volume in a closed position.

12. The compressor of claim 11, wherein the valve comprises a main body having an inward-facing surface exposed to the inner volume of the casing, wherein the inward-facing surface is substantially flush with the inner surface of the casing in the closed position.

13. The compressor of claim 11, wherein the casing comprises a fluid passage fluidly coupled to an economizer of the HVAC system, wherein the valve is configured to fluidly couple the fluid passage to the inner volume via the bore in the open position.

14. The compressor of claim 13, wherein the fluid passage comprises a first portion extending from an outer surface of the casing and through the casing.

15. The compressor of claim 14, wherein the fluid passage comprises a second portion extending from the first portion to the bore of the economizer port, wherein the second portion extends about a circumference of the bore.

16. The compressor of claim 11, wherein the bore comprises a recess, the valve comprises a main body and a protrusion extending from the main body, wherein the protrusion is disposed within the recess and is configured to block rotation of the main body within the bore.

17. A compressor of a heating, ventilation, and air conditioning (HVAC) system, comprising:

a housing comprising an inner volume and an inner surface defining the inner volume, wherein the inner volume is configured to accommodate a rotor therein;

an economizer port formed in the housing and configured to direct vapor refrigerant from an economizer of the HVAC system into the inner volume; and a valve disposed within the economizer port and configured to regulate a flow of vapor refrigerant into the inner volume, wherein the valve comprises a main body having a radially inward surface, wherein the radially inward surface is substantially flush with the inner surface of the housing in a closed position of the valve.

18. The compressor of claim 17, comprising an actuator coupled to the main body of the valve, wherein the actuator is configured to transition the valve between the closed position and an open position to control the flow of vapor refrigerant into the inner volume.

19. The compressor of claim 17, wherein the valve is configured transition to an open position to enable fluid communication between the inner volume and a fluid passage formed in the housing and configured to receive the flow of vapor refrigerant from the economizer.

20. The compressor of claim 17, wherein the economizer port comprises a bore formed in the housing, the bore comprises a valve seat, the main body comprises a recess formed therein, and the valve seat is configured to be disposed within the recess and engage with the main body to create a sealing interface between the valve seat and the main body in the closed position.

* * * * *